US008197261B2

(12) United States Patent
Lee

(10) Patent No.: US 8,197,261 B2
(45) Date of Patent: Jun. 12, 2012

(54) TELECOMMUNICATION CONNECTOR HAVING A FLEXIBLE CIRCUIT BOARD WOUND ACROSS A SUPPORT MEMBER AND ENDS BEING BENT INTO FIXING PLATES COUPLED TO TWO ROWS OF TERMINALS

(75) Inventor: Chen-Wei Lee, Taipei (TW)

(73) Assignee: Hsing Chau Industrial Co., Ltd. (TW)

( * ) Notice: Subject to any disclaimer, the term of this patent is extended or adjusted under 35 U.S.C. 154(b) by 268 days.

(21) Appl. No.: 12/776,455

(22) Filed: May 10, 2010

(65) Prior Publication Data

US 2011/0275248 A1 Nov. 10, 2011

(51) Int. Cl.
*H01R 12/00* (2006.01)

(52) U.S. Cl. ..... 439/67

(58) Field of Classification Search ..... 439/62, 439/67, 494, 404, 676, 668
See application file for complete search history.

(56) References Cited

U.S. PATENT DOCUMENTS 3,582,865 A * 6/1971 Franck et al. ..... 439/67
5,316,486 A * 5/1994 Tanaka et al. ..... 439/62
5,415,560 A * 5/1995 Balyasny ..... 439/269.1
5,507,651 A * 4/1996 Tanaka et al. ..... 439/67
7,717,715 B2 * 5/2010 Grover et al. ..... 439/62
7,857,635 B2 * 12/2010 Goodrich et al. ..... 439/76.1
7,857,667 B1 * 12/2010 Wang ..... 439/676
7,883,376 B2 * 2/2011 Milette et al. ..... 439/676
7,896,688 B2 * 3/2011 Sukegawa et al. ..... 439/494
2007/0270042 A1 * 11/2007 Belopolsky et al. ..... 439/668

* cited by examiner

*Primary Examiner* — Chandrika Prasad
(74) *Attorney, Agent, or Firm* — Schmeiser, Olsen & Watts, LLP

(57) ABSTRACT

A telecommunication connector includes a front holder having a plug port at the front and a press plate at the rear, a rear holder coupled to the rear of the front holder, a support member disposed at the front of the rear holder and extended to the top of the plug port, two rows of terminals installed at the rear holder, a flexible circuit board bent into the electric connecting plate and the extension plate, a curved portion wound across the front of the support member of the rear holder, such that the electric connecting plate is passed through the bottom of the support member and entered into the top of the plug port, and a fixing plate separately bent at rear ends of the electric connecting plate and the extension plate and pushed to the front of the rear holder by the press plate and coupled to the terminals.

10 Claims, 3 Drawing Sheets

TELECOMMUNICATION CONNECTOR HAVING A FLEXIBLE CIRCUIT BOARD WOUND ACROSS A SUPPORT MEMBER AND ENDS BEING BENT INTO FIXING PLATES COUPLED TO TWO ROWS OF TERMINALS

FIELD OF THE INVENTION

The present invention relates to a connector, in particular to a telecommunication connector having a flexible circuit board and a socket provided for a quick connection.

BACKGROUND OF THE INVENTION

A conventional RJ45 connector used for connecting Ethernet generally adopts a rectangular socket jack made of an insulating plastic material by a plastic injection molding process, and the socket jack includes a rectangular plug port concavely disposed at a front end of the socket jack, eight gold pins bent into a V-shape and passed through the top in the plug port, and a rear end of each gold pin is extended to a rear end of the socket jack and soldered with the eight terminals, such that the terminal is coupled to a sub-wire of an Ethernet cable, and the plug port is disposed at the front end of the socket jack and provided for a quick insertion of a plug of the connector. After the plug of the connector is inserted, the eight gold pins are electrically connected to eight metal contacts of the plug of the connector. However, the gold pins of the conventional connector must be soldered to the terminals at the rear end. As a result, the manufacturing and assembling processes of the connector are relatively troublesome, and the production cost cannot be lowered effectively.

In addition, the gold pins in the plug port at the front end of the conventional connector are made by stamping a copper wire, such that after each gold pin is bent into a V-shape, the bent angle has been fixed theoretically, so that the elasticity of the gold pins remains constant. However, the precision of the bent angle of the gold pins is affected easily by factors such as the related mold and stamping technology. Therefore, it is difficult to control the quality of the elasticity of the gold pins. If the elasticity is too small, the gold pins will not comply with a desired specification, and many product designs and manufactures try to increase the elasticity of the gold pins. As a result, the elasticity may be too large, and may result in a difficulty of unplugging an inserted plug of the connector from the port.

Therefore, it is a main subject of the present invention to develop a telecommunication connector without employing the conventional gold pins and terminal soldering structure, such that the telecommunication connector of the invention can achieve the effects of simplifying the manufacturing and assembling processes, lowering the cost effectively, and stabilizing the quality of the elasticity.

SUMMARY OF THE INVENTION

In view of the foregoing drawbacks of the prior art, the inventor of the present invention based on years of experience in the related industry to conduct extensive researches and experiments, and finally developed a telecommunication connector in hope of achieving the effects of simplifying the manufacturing and assembling processes, lowering the cost and stabilizing the quality of the elasticity effectively.

Therefore, it is a primary objective of the present invention to provide a telecommunication connector that replaces the conventional gold pins by a flexible circuit board. With the structural design of a front holder and a rear holder, a constant force can be applied to the flexible circuit board for assembling and connecting the front holder and the rear holder quickly, such that the flexible circuit board and the terminals can be electrically connected, and the conventional gold pins and soldering structures can be omitted to achieve the effects of simplifying the manufacturing and assembling processes, lowering the cost and stabilizing the quality of the elasticity effectively.

To achieve the foregoing objective, the telecommunication connector of the present invention comprises: a front holder, including a plug port concavely installed at a front end of the front holder, a containing groove concavely formed at a rear end of the front holder and interconnected with a top side of the plug port, and a press plate with a backward pushing force and separately installed on upper and lower sides of the rear end of the front holder rear end; a rear holder, coupled to a rear end of the front holder, and having a support member installed at a front end of the rear holder and passed into the containing groove and extended to a top side of the plug port; two rows of terminals, inserted into upper and lower portions of the rear holder symmetrically and respectively, and a front end of the two rows of terminals being exposed from the front end of the rear holder, and a rear end of the two rows of terminals being exposed from the rear end of the rear holder; and a flexible circuit board, bent and folded into an electric connecting plate and an extension plate, and a curved portion wound across the front end of the support member of the rear holder, wherein the electric connecting plate is passed through a bottom side of the support member and entered into a top side of the plug port, and the extension plate is attached onto the top side of the support member, and a fixing plate is separately bent at rear ends of the electric connecting plate and the extension plate, and each fixing plate is propped and pushed to the front end of the rear holder by the press plate of the front holder and each fixing plate is coupled to the two rows of terminals, so as to form the telecommunication connector.

The front holder is made of an insulating plastic material and comprised of the integrally formed plug port, containing groove and press plate, and the press plate is an L-shaped plate integrally formed with the front holder. The rear holder is made of an insulating plastic material and comprised of the integrally formed support member, and two rows of terminal fixing blocks are protruded from the upper and lower portions at the rear end of the rear holder for fixing the rear ends of the two rows of terminals respectively. An elastic plate is installed at a bottom side of the support member of the rear holder and entered into the top side of the plug port, and attached onto an internal side of the electric connecting plate of the flexible circuit board, and the elastic plate pushes the electric connecting plate to enter into a top side of the plug port. The electric connecting plate of the flexible circuit board is bent into a V-shape plate, and the V-shaped front oblique surface is pushed and pressed by the elastic plate into the top side of the plug port. The front oblique surface includes a plurality of ditches arranged in rows, and a telecommunication connection portion is formed between the ditches. The electric connecting plate of the flexible circuit board and the fixing plate at the rear end of the extension plate separately include a positioning hole formed at a front side of the rear holder. A positioning pillar is disposed at the front side of the rear holder and passed through the positioning hole, and a rear cover is coupled to the rear end of the rear holder.

The telecommunication connector of the present invention can achieve the effects of simplifying the manufacturing and assembling processes, lowering the cost and stabilizing the quality of the elasticity effectively.

The objects, characteristics and effects of the present invention will become apparent with the detailed description of preferred embodiments and the illustration of related drawings as follows.

DESCRIPTION OF THE PREFERRED EMBODIMENTS

Figure 1:
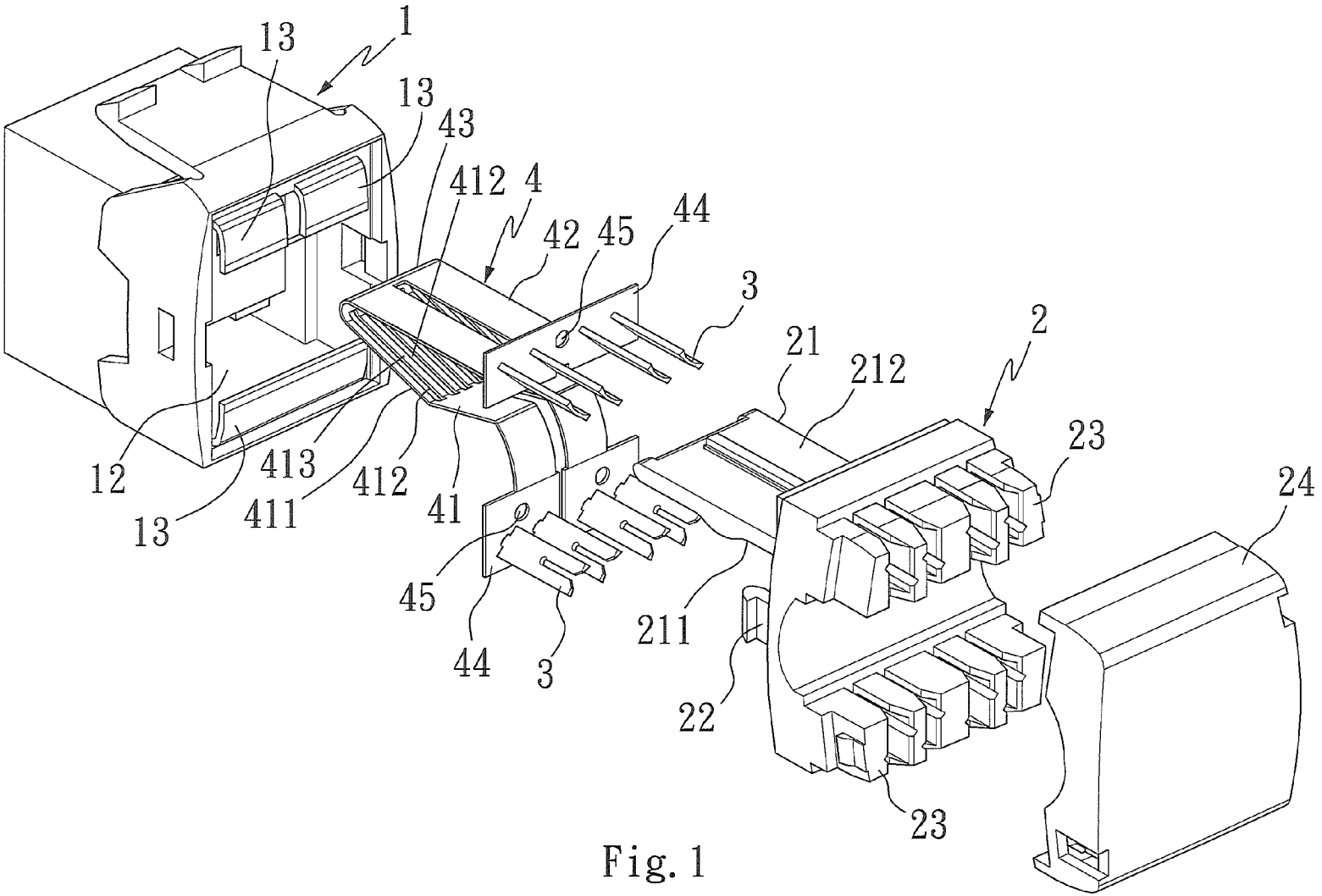
FIG. 1 is an exploded view of a preferred embodiment of the present invention.
Figure 2:
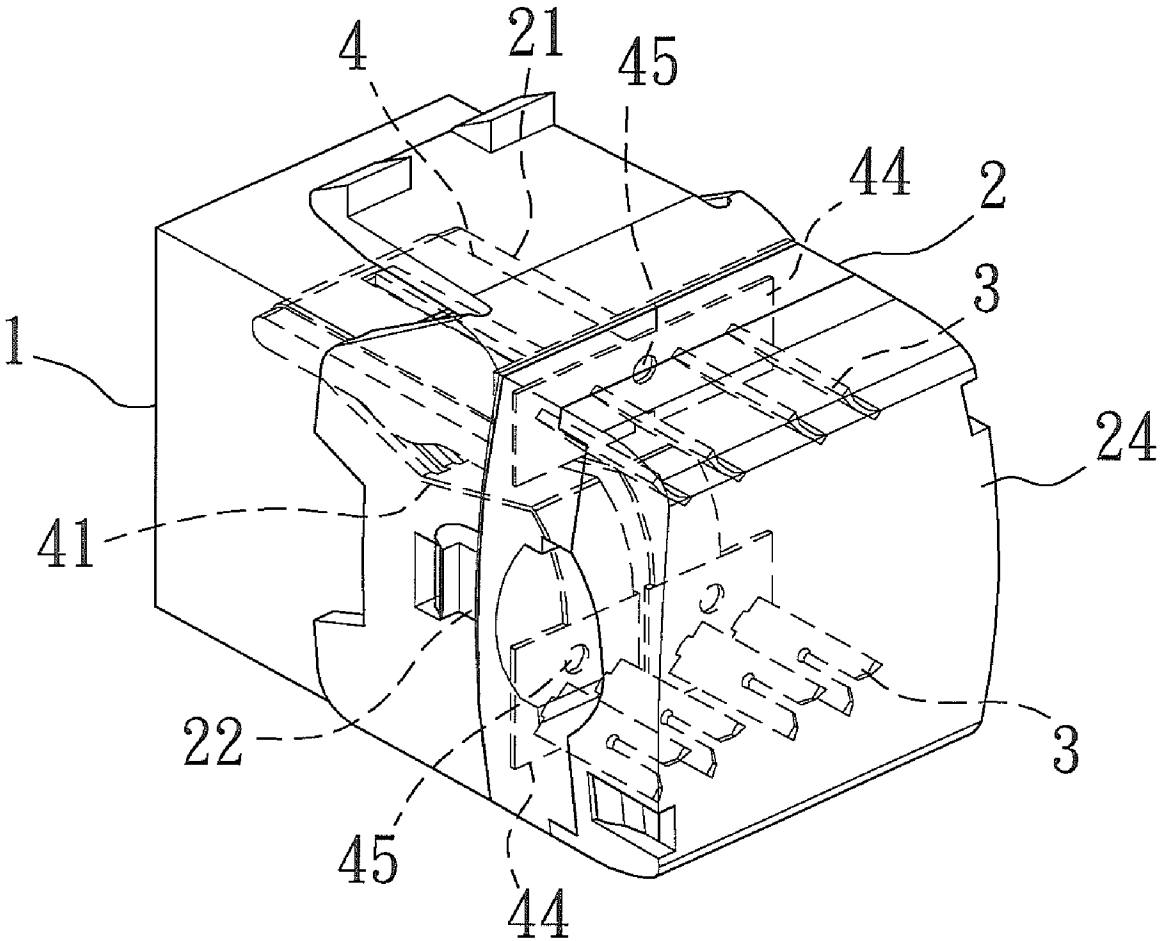
FIG. 2 is a perspective view of a preferred embodiment of the present invention.
Figure 3:
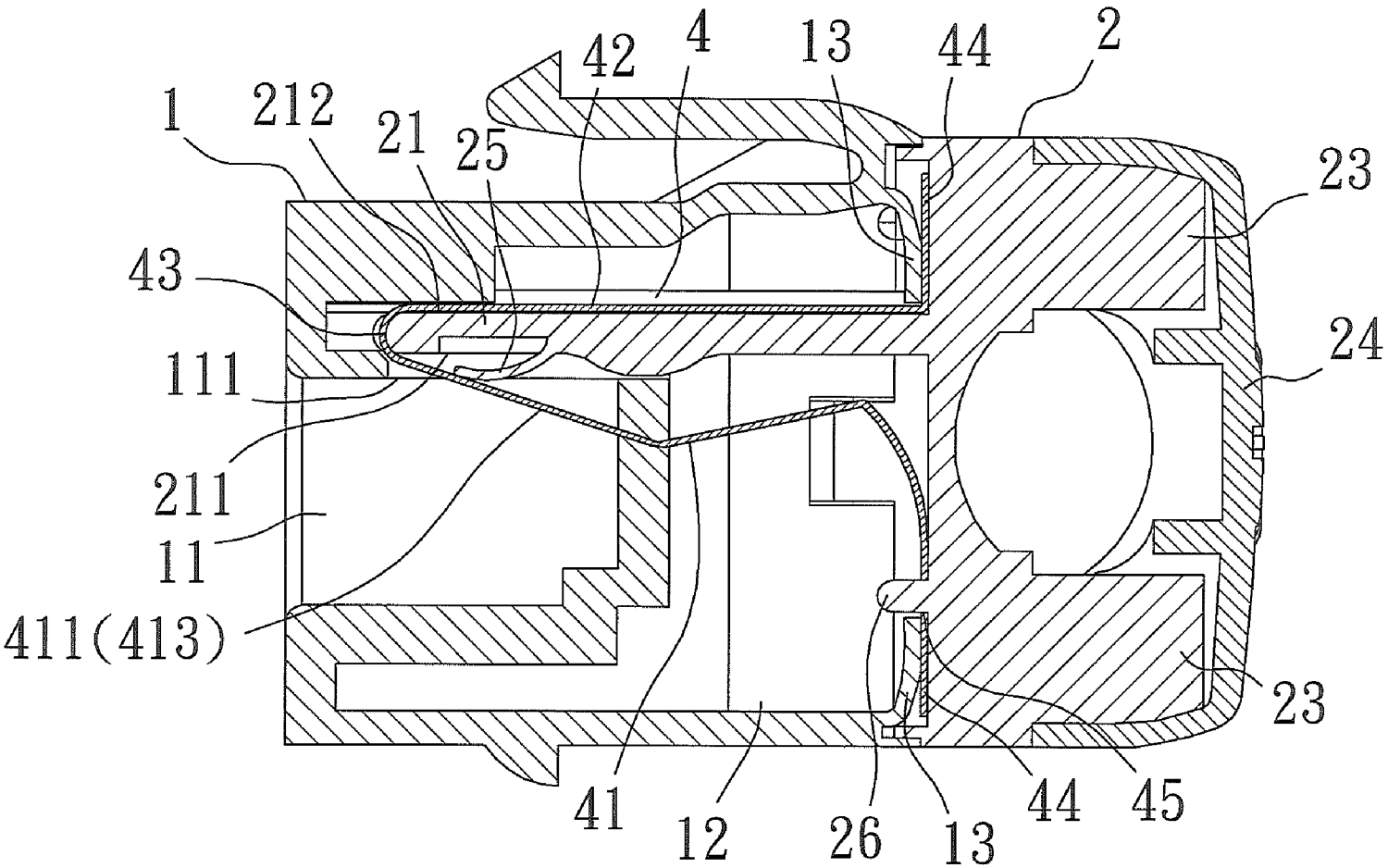
FIG. 3 is a cross-sectional view of a preferred embodiment of the present invention.

With reference to FIGS. 1 to 3 for a telecommunication connector in accordance with a preferred embodiment of the present invention, the telecommunication connector comprises a front holder 1, a rear holder 2, two rows of terminals 3 and a flexible circuit board 4.

The front holder 1 includes a rectangular plug port 11 concavely formed at a front end of the front holder 1, and a containing groove 12 in a rectangular or any other shape formed in a rear end of the front holder 1, wherein the containing groove 12 is interconnected to a top side 111 of the plug port 11, and a press plate 13 is installed separately at upper and lower sides of the rear end of the front holder 1 and possesses a backward pushing force.

A snap plate 22 is separately disposed on both sides of the rear holder 2 and provided for coupling the rear end of the front holder 1, and a support member 21 is disposed at the front end of the rear holder 2, passed into the containing groove 12 of the front holder 1, and extended to the top side 111 of the plug port 11, wherein the support member 21 is a rectangular plate.

The two rows of terminals 3 are inserted into upper and lower portions of the rear holder symmetrically and respectively 2, and front ends of the two rows of terminals 3 are exposed from the front end of the rear holder 2, and rear ends of the two rows of terminals 3 are exposed from the rear end of the rear holder 2, so that the symmetric structure of the two rows of terminals 3 can reduce or eliminate the interference of noises.

The flexible circuit board 4 is bent and folded into an electric connecting plate 41 and an extension plate 42, and the curved portion 43 is wound across the front end of the support member 21 of the rear holder 2, such that the electric connecting plate 41 is passed through a bottom side 211 of the support member 21 and entered into a top side 111 of the plug port 11, and the extension plate 42 is attached and fixed onto a top side 212 of the support member 21; and at least one fixing plate 44 is formed by bending rear ends of the electric connecting plate 41 and the extension plate 42, and each fixing plate 44 is propped and pushed by the press plate 13 at the rear end of the front holder 1 and attached onto the front end of the rear holder 2, such that printed contacts of each fixing plate 44 are coupled to the two rows of terminals 3 respectively to constitute the telecommunication connector of the present invention.

In FIGS. 1 to 3, a preferred embodiment of the present invention further comprises the front holder 1 made of an insulating plastic material and integrally formed with the plug port 11, the containing groove 12 and the press plate 13, wherein the press plate 13 is an L-shaped plate integrally formed with the rear end of the front holder 1, and a backward pushing force is produced to prop and push the fixing plate 44 of the flexible circuit board 4 to attach the front end of the rear holder 2. The rear holder 2 is made of an insulating plastic material and integrally formed with the support member 21 and the snap plate 22, and two rows of terminal fixing blocks 23 are protruded from upper and lower portions at the rear end of the rear holder 2, and the two rows of terminal fixing blocks 23 are provided for fixing the rear ends of the two rows of terminals 3. The rear end of the rear holder 2 is coupled to a rear cover 24 of a plastic injection molding for clamping a network cable.

In FIG. 3, an arc elastic plate 25 is integrally formed with the bottom side 211 of the support member 21 of the rear holder 2 and entered into the top side of the plug port 11 of the front holder 1, such that the elastic plate 25 is attached onto an internal side of the electric connecting plate 41 of the flexible circuit board 4 to provide an electric connecting plate 41 of the flexible circuit board 4 with an excellent elasticity as well as a stable quality of elasticity. By the elasticity of the elastic plate 25, the electric connecting plate 41 is pushed into the top side 111 of the plug port 11. In FIGS. 1 and 3, the electric connecting plate 41 of the flexible circuit board 4 can be bent into a V-shape, such that the V-shaped front oblique surface 411 is pushed and pressed by the elastic plate 25 into the top side 111 of the plug port 11 and provided for contacting a metal contact of the connector plug. The front oblique surface 411 includes a plurality of ditches 412 arranged in rows, a telecommunication connection portion 413 formed between the ditches 412, and a contact printed onto the telecommunication connection portion 413 and electrically connected with a metal contact of a connector plug.

In the present invention as shown in FIGS. 1 and 3, a positioning hole 45 is formed on the fixing plate 44 at the rear end of the electric connecting plate 41 and the extension plate 42 of the flexible circuit board 4 for coupling the front of the rear holder 2, and a positioning pillar 26 is disposed at the front of the rear holder 2 and passed through the positioning hole 45, such that a terminal insertion machine (or a pin insertion machine) can be used to insert two rows of terminals 3 into the upper and lower portions of the rear holder 2, and then the fixing plate 44 of the flexible circuit board 4 is combined with the positioning pillar 26 at the front of the rear holder 2 through the positioning hole 45 in an assembling operation, such that the rear holder 2, the terminal 3 and the flexible circuit board 4 constitute a module, and finally the rear holder 2 is coupled to the rear end of the front holder 1 through the snap plate 22 to constitute the telecommunication connector.

Since circuits and circuit contacts are printed onto the electric connecting plate 41, the extension plate 42 and the fixing plate 44 of the flexible circuit board 4 in the present invention, the press plate 13 can be passed through the rear end of the front holder 1, when the rear holder 2 and the terminal 3 are combined with the flexible circuit board 4 by the aforementioned assembling method. If the rear holder 2 is coupled to the rear end of the front holder 1, the press plate 13 at the rear end of the front holder 1 will prop and push the fixing plate 44 to be attached onto the front end of the rear holder 2, and the printed contacts of the fixing plate 44 are in a contact with the two rows of terminals 3 closely, so that the conventional soldering operation and soldering structure can be omitted to simplify the entire manufacturing and assembling processes and lower the cost effectively.

In the present invention, the elastic plate 25 is integrally formed with the bottom side 211 of the support member 21 of the rear holder 2, and the elastic plate 25 pushes the electric connecting plate 41 into the top side 111 of the plug port 11, such that the circuit contact of the electric connecting plate 41 can be electrically connected to the metal contact of the connector plug. In the design of the elasticity of the elastic plate 25, the mold used for the injection molding process can be revised in advance to control the stability of the elasticity of the elastic plate 25, so as to overcome the difficulty of controlling the elasticity caused by the conventional gold pin stamping technology.

In summation of the description above, the present invention adopts the front holder 1, rear holder 2, two rows of terminals 3 and flexible circuit board 4 to manufacture and assemble the telecommunication connector without requiring any soldering structure or method and overcome the conventional gold pin stamping technology that causes the issue and difficulty of controlling the elasticity and achieves the effects of simplifying the manufacturing and assembling processes, lowering the cost effectively, and stabilizing the elasticity. The present invention complies with patent application requirements, and products derived by the present invention meets the market requirements sufficiently.

While the invention has been described by means of specific embodiments, numerous modifications and variations could be made thereto by those skilled in the art without departing from the scope and spirit of the invention set forth in the claims.

What is claimed is:

1. A telecommunication connector, comprising:

a front holder, including a plug port concavely installed at a front end of the front holder, a containing groove formed at a rear end of the front holder and interconnected to a top side of the containing groove, and a press plate possessing a backward pushing force and separately disposed on upper and lower sides of the rear end of the front holder;

a rear holder, coupled to a rear end of front holder, and including a support member installed at the front end of the rear holder, extended into the containing groove and further extended to the top side of the plug port;

two rows of terminals, inserted into upper and lower portions of the rear holder symmetrically and respectively, and front ends of the two rows of terminals being exposed from a front end of the rear holder, and rear ends of the two rows of terminals being exposed from a rear end of the rear holder; and a flexible circuit board, bent and folded into an electric connecting plate and an extension plate, and a curved portion being wound across the front end of the support member of the rear holder, and the electric connecting plate being passed through the bottom side of the support member and entered into the top side of the plug port, and the extension plate being attached onto the top side of the support member, and rear ends of the electric connecting plate and the extension plate being bent into fixing plates respectively, and each fixing plate being propped and pushed at the front end of the rear holder by the press plate of the front holder, and each fixing plate being separately coupled to the two rows of terminals to constitute the telecommunication connector.

2. The telecommunication connector of claim 1, wherein the front holder is made of an insulating plastic material and comprised of the integrally formed plug port, containing the groove and the press plate.

3. The telecommunication connector of claim 2, wherein the press plate of the front holder is an L-shaped plate.

4. The telecommunication connector of claim 1, wherein the rear holder is made of an insulating plastic material and comprised of the integrally formed support member, and two rows of terminal fixing blocks are protruded from upper and lower portions at the rear end of the rear holder and fixed to rear ends of the two rows of terminals respectively.

5. The telecommunication connector of claim 1, further comprising an elastic plate installed at the bottom side of the support member of the rear holder and entered into the top side of the plug port, and attached onto an internal side of the electric connecting plate of the flexible circuit board for pushing the electric connecting plate into the top side of the plug port.

6. The telecommunication connector of claim 5, wherein the electric connecting plate of the flexible circuit board is bent into a V-shaped plate, and the V-shaped plate has a front oblique pushed and pressed into the top side of the elastic plate.

7. The telecommunication connector of claim 6, wherein the front oblique surface includes a plurality of ditches arranged into rows, and a telecommunication connection portion is formed between the ditches.

8. The telecommunication connector of claim 1, wherein the electric connecting plate of the flexible circuit board and the fixing plate at the rear end of the extension plate include a positioning hole for coupling the rear holder.

9. The telecommunication connector of claim 8, further comprising a positioning pillar disposed at the front of the rear holder and passed into the positioning hole.

10. The telecommunication connector of claim 1, further comprising a rear cover coupled to the rear end of the rear holder.

* * * * *